US005348091A

United States Patent [19]

Tchakarov et al.

[11] Patent Number: 5,348,091

[45] Date of Patent: Sep. 20, 1994

[54] SELF-ADJUSTING CENTRALIZER

[75] Inventors: Borislav J. Tchakarov; Leon Earl, both of Lafayette, La.

[73] Assignee: The Bob Fournet Company, Lafayette, La.

[21] Appl. No.: 107,092

[22] Filed: Aug. 16, 1993

[51] Int. Cl.[5] ..... E21B 17/10

[52] U.S. Cl. ..... 166/217; 166/241.6

[58] Field of Search ..... 175/50, 325.4; 166/217, 166/65.1, 241.5, 241.6

[56] References Cited

U.S. PATENT DOCUMENTS

| | | | |
|---|---|---|---|
| 2,171,539 | 9/1939 | Burns | 166/241.5 X |
| 2,333,348 | 11/1943 | Tucker | 166/241.6 X |
| 3,087,552 | 4/1963 | Graham | 166/241.5 X |
| 4,130,816 | 12/1978 | Vogel et al. | 166/241.5 X |
| 4,243,099 | 1/1981 | Rodger, Jr. | 166/241.5 X |
| 4,697,638 | 10/1987 | Knight | 166/65.1 |
| 4,790,381 | 12/1988 | Armell | 166/241.5 |

*Primary Examiner*—Ramon S. Britts
*Assistant Examiner*—Frank S. Tsay
*Attorney, Agent, or Firm*—Joseph L. Lemoine, Jr.

[57] ABSTRACT

An oil-field tool for use in combination with a MWD tool, for deployment and retrieval of a MWD tool through a drill string, and, for rigid continuously self-adjusting, centralization of the MWD tool during drilling, includes: housing having a tapering nose; slidable shaft having a flared portion; extendable fingers pivotably attached to the slidable shaft; means for releasable attachment to a workstring; and, means for attachment to a MWD tool.

Typically, the housing of the invention is attached to a MWD tool while at the surface and the combined apparatus is lowered through the drill string by wireline releasably attached to the slidable shaft. During lowering, the weight of the housing and MWD tool extends the slidable shaft, positioning the extendable fingers above the tapering nose of the housing, thereby retracting the fingers. When the MWD tool lodges downhole, the slidable shaft moves downward, causing the fingers to override the tapering nose of the housing and extend the fingers outward against the drill pipe. During drilling operations mud flowing through the drill pipe acts downwardly on flared portion of the slidable shaft inducing more forceable extension of the fingers against the drill pipe, maintaining rigid centralization of the MWD. Retrieval of the MWD is typically had by interrupting mud flow and lifting of the self-adjusting centralizer through the drill string by wireline.

19 Claims, 1 Drawing Sheet

FIG. 1
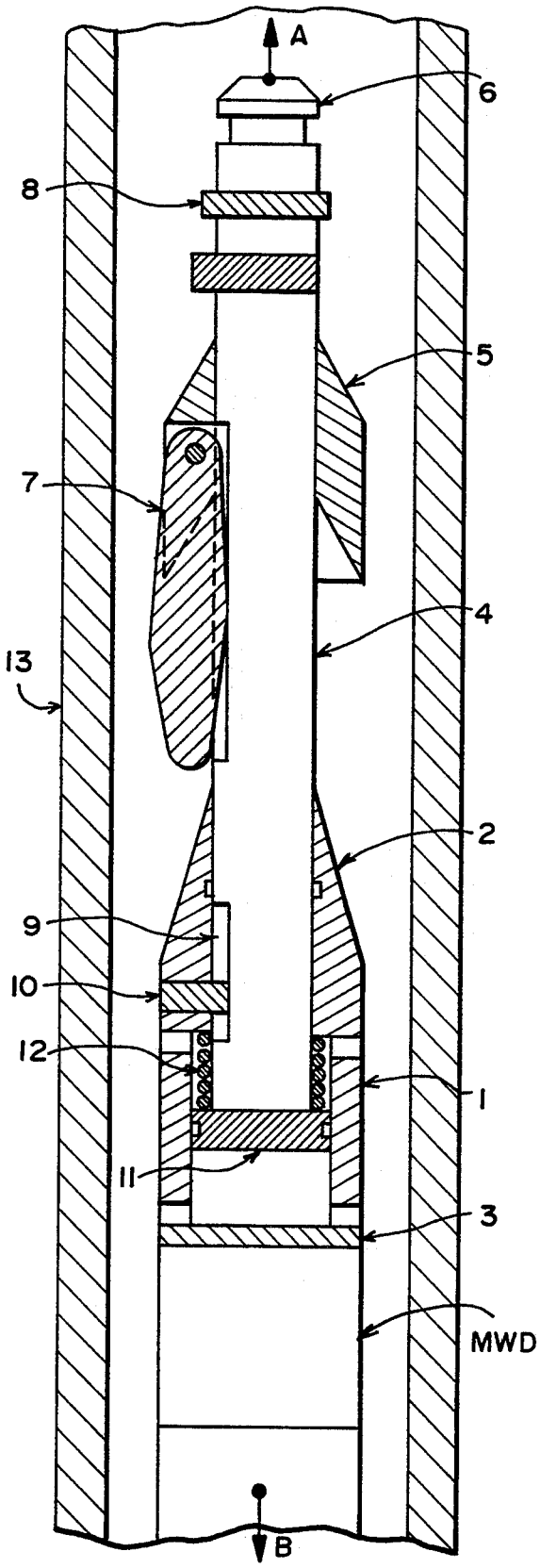
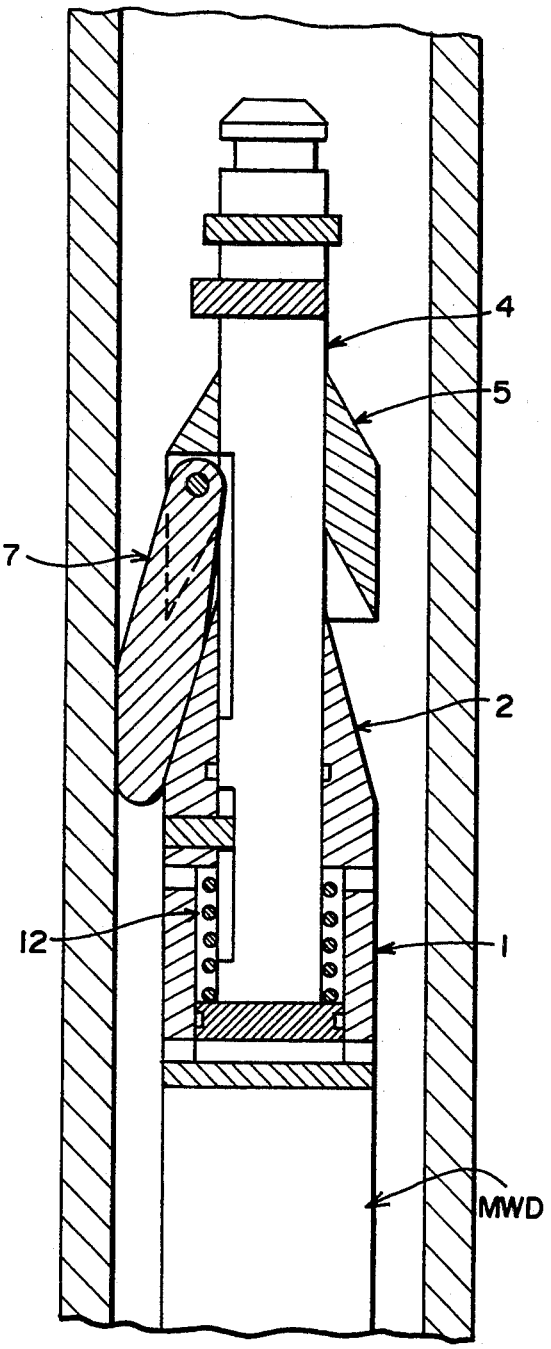
FIG. 2

SELF-ADJUSTING CENTRALIZER

BACKGROUND OF THE INVENTION

1. Field of Invention

The invention generally relates to the field of earth-boring (drilling) technology. With more particularity the invention is designed to be used in combination with downhole signal generators which are used to acquire "real time" downhole data during drilling and transmit same to the surface for interpretation (herein called "MWD", including, but not limited to, tools which transmit data by means of mud pulses and tools which transmit data by electric line, sometimes referred to as steering tools). The invention relates to means to centrally stabilize MWD tools during drilling yet provide convenient means for deployment and removal of MWD tools downhole without the necessity of removing or reinserting the drill string from the hole.

2. General Background

In the art of earth-boring MWD represents an improvement over previous drilling process. MWD allows for the surface acquisition of downhole data during drilling, thereby reducing the need for costly and time consuming drill string tripping and logging/survey runs otherwise necessary to acquire downhole data. Further, the acquisition of "real time" data during drilling can be of substantially greater value than later acquired data. MWD can be used to monitor downhole temperature and pressure, monitor formation properties, monitor bit weight and torque, control direction of the well, detect abnormally pressured formations, evaluate potentially productive formations and monitor-/evaluate other important downhole conditions.

MWD systems typically include the placement of a complex and expensive self-contained package of sensors, encoders, power supplies and transmitters immediately above, or very near, the drill bit. While this position is desirable for sensing the variables in question, it presents a harsh, hot, highly pressured, dirty and high shock load environment for the MWD tool. MWD tool failures are not uncommon, requiring retrieval and replacement of the tool downhole. In the event the drill pipe becomes stuck in the hole the MWD tool may be permanently lost.

Early MWD tools were typically made up as an integral part of the bottom hole assembly. However, this arrangement is not ideal. In the event of MWD tool failure the entire drill string had to be tripped out and back in the hole to replace the MWD tool. Further, in the event of loss of the bottom hole assembly due to twist off or sticking the expensive MWD tool was lost. Thus retrievable MWD systems were developed.

A retrievable MWD system utilizes a passive receptacle which is run into the wellbore as part of the bottom hole assembly. Contained within this receptacle is a removable MWD electronics package which can be retrieved through the drill string. In the event of a tool failure, downtime is minimal because the electronic components can be retrieved and replaced by wireline (or coiled tubing), eliminating the time consuming necessity, of tripping the entire drill string. If the drill string itself were to become permanently stuck, the expensive MWD electronics package may be retrievable prior to abandonment of the bottom hole assembly.

It is well documented that downhole vibration can be severe during the drilling process. One study, SPE-/IADC 16109, found that bottom hole assemblies can be subjected to lateral shocks in excess of 200 g's, and axial vibrations of up to 3.5 g's during drilling operations. While these vibrations can have a harmful effect on almost any downhole equipment, the shocks are especially damaging to the sensitive electronics of MWD systems in general, and retrievable MWD systems in particular. As these downhole vibrations act on retrievable MWD tools, the removable components have a tendency to rattle or bang against the internal walls of the surrounding MWD receptacle thereby amplifying vibrations. Thus, to reduce the potential damage caused by these downhole shocks, it is desirable to centralize and secure the inner electronic components of retrievable MWD systems within their surrounding MWD receptacles.

Currently, one common method of improving the centralization of retrievable MWD tools involves the use of donut shaped rubber rings. These rubber rings are placed around the circumference of retrievable MWD tools to increase their outer diameter and at cushion some of the shock effects described above. However, this method is not ideal. Because the inner MWD components are designed to be retrieved through the drill string, the tool's largest outer diameter must always be smaller than the smallest drill string restriction; otherwise, a tool could not pass through the drill string restriction on its way to the surface. Accordingly, the rubber rings used to centralize retrievable MWD tools must also be sized to pass through the smallest drill pipe restriction which will be encountered. This sizing limitation results in a less than tight fit between the retrievable MWD tool and the surrounding MWD receptacle, which hinders the effectiveness of the centralizer rings. Although the rubber centralizer rings provide some benefit, the lack of a tight fit still permits some amplification of the downhole shocks on the retrievable MWD tool. Therefore, the need exists for a centralizer which can pass through relatively small drill string restrictions, but which can also rigidly centralize and secure a retrievable MWD tool from movement within a downhole MWD receptacle.

SUMMARY OF THE INVENTION

The apparatus of the present invention solves the shortcomings in the art with respect to stabilization versus retrievability of MWD packages. The object of the present invention is to provide an apparatus for rigid, self-adjusting, centralization and stabilization of MWD packages within the bottom hole assembly during drilling, without sacrificing retrievability of the MWD package in the event of package failure or loss of the bottom hole assembly in the wellbore. Conceptually the present invention provides a MWD stabilizing assembly which is of variable diameter, a small diameter when being tripped in and out of the drill string, and a larger, forcibly "tight", self-adjusting, diameter during actual drilling operations. In the preferred embodiment this is accomplished by extendable fingers pivotally attached to a slide. When the slide is compressed into a housing the fingers override a tapering surface which "wedges" them outward and into contact with the inner diameter of the drill string. When the slide is extended the fingers are away from the tapering surface and are retracted to form a smaller cross-sectional area which may pass through the drill string. Compression, extension, and force of compression of the slide is responsive to weight of the components, the hydraulic pressure produced by mud (drilling fluid) flow acting upon a flared portion of the slide and the urging of a spring means.

BRIEF DESCRIPTION OF THE DRAWINGS

FIG. 1 is a longitudinal cross-sectional view of the preferred embodiment of the apparatus of the present invention with retracted fingers.

FIG. 2 is a longitudinal cross-sectional view of the preferred embodiment of the apparatus of the present invention with extended fingers.

PREFERRED EMBODIMENT OF THE PRESENT INVENTION

FIG. 1 depicts the preferred embodiment of the present invention in the retracted mode, in which mode the invention would be while being inserted or removed from the drill string. FIG. 2 depicts the preferred embodiment of the present invention in the extended mode, in which mode the invention would be during drilling.

Referring initially to FIG. 1 the preferred embodiment is comprised of three major components. The first is housing, 1, having tapering nose portion, 2, and means (depicted as a bolting plate), 3, for attachment to MWD.

The second major component is shaft, 4, which is slidably disposed in an axial bore of housing, 1. Shaft, 4, includes flared portion, 5, and means (depicted as a grapple neck), 6, for releasable attachment to wireline, coiled tubing or other suitable work string.

The third major component is a plurality of fingers (one shown), 7, which are disposed equidistantly about the shaft, 4. The upper end of fingers, 7, are pivotally attached to the underside of flared portion, 5, of shaft, 4.

In the preferred embodiment shaft, 4, also has orienting pin for magnetic surveys, 8; slot, 9, for installing shaft retaining screw, 10; and, end plate, 11, on which compression spring, 12, acts.

In FIG. 1 the self-adjusting centralizer is suspended within the drilling pipe, 13, by force A (typically wireline, but may be coiled tubing or other suitable work string), which acts directly on shaft, 4. Weight of the MWD assembly, B, operates in the opposite direction on housing, 1. The effect of opposite forces, A and B, fully extends shaft, 4, from housing, 1. With shaft, 4, so extended fingers, 7, "close", or retract, under their own weight. So retracted the self-adjusting centralizer has a small radial cross-section which may easily pass through drill pipe, 13.

FIG. 2, on the other hand, depicts the preferred embodiment of the present invention in its extended mode, as it would appear during drilling operations. In this mode the bottom of the MWD tool has lodged home (typically into a passive "hub") immediately above a drilling motor and weight of the MWD tool is now supported by said hub. Force B (of FIG. 1) is therefore no longer applied to the self-adjusting centralizer. Once the MWD tool is lodged home the wireline, coil tubing or other suitable workstring which has been used to lower the centralizer/MWD combination into the hole is typically released and force A (of FIG. 1) is also no longer applied to the self-adjusting centralizer. In the absence of forces A and B extending shaft, 4, from housing, 1; shaft, 4, retracts into housing, 1, under the combined influences of compression spring, 12, and weight of shaft, 4. Retraction of shaft, 4, into housing, 1, causes fingers, 7, to override tapering nose portion, 2, thereby pushing the lower end of fingers, 7, outward and wedging against drill pipe, 13.

During operations when mud (drilling fluid) is flowing downward through the drill pipe, flared portion, 5, of shaft, 4, accelerates mud flowing thereby, causing a hydraulic force to act downwardly on shaft, 4, wedging fingers, 7, even more forcibly against drill pipe, 13. During drilling the combination of said hydraulic force, spring, 12, and weight of shaft, 4, causes the fingers, 7, to exert continuous outward directed force against drill pipe, 13, assuring rigid, automatically self-adjusting centralization of the MWD tool; even if wear or temperature variances causes dimensional changes between the components.

The self-adjusting centralizer is typically attached to a MWD at the surface and is usually lowered into position by of wireline attached to shaft, 4. Should the wireline break or detach from the self-adjusting centralizer the absence of force A (of FIG. 1) and urging of spring, 12, will automatically extend the fingers, 7, thereby braking the combined MWD (centralizer against falling, thereby preventing possible damage to the MWD tool and other downhole components (such as MWD hub, mud motors, etc.). On lodging of the MWD tool downhole the wireline is usually released to allow the self-adjusting centralizer to lock in place. Retrieval is typically by grappling the shaft and pulling upward by means of wireline. It may be necessary to temporarily cease mud flow to allow the self-adjusting centralizer to unlock.

Other embodiments of the self-adjusting centralizer are possible. For instance the extendable fingers could be pivotally attached to the housing and a tapering surface to extend them attached to the slidably disposed shaft. Either the shaft or housing could be above the other.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A self-adjusting centralizer, for use in combination with a MWD tool, comprising:
   (a) an extended housing having a longitudinal bore, a first end having a tapering nose, and a second end having means for attachment of said housing to a MWD tool;
   (b) an extended shaft comprised of a first portion slidably disposed in the longitudinal bore of the first end of the extended housing and a second portion, having an end means for releasable attachment of the shaft to a workstring, disposed externally of said longitudinal bore, and;
   (c) a plurality of fingers having a first end pivotally attached to the second portion of the extended shaft, and a second end slidably overriding the tapering nose of the extended housing.

2. The apparatus of claim 1 wherein said extended shaft is also comprised of an outwardly flaring portion which is disposed between the external end of said shaft and said fingers.

3. The apparatus of claim 2 wherein the first end of said fingers is pivotally attached to a surface of said flared portion which is disposed toward the tapering nose of the housing.

4. The apparatus of claim 1 further comprising a spring means which urges said shaft into said housing.

5. The apparatus of claim 2 further comprising a spring means which urges said shaft into said housing.

6. The apparatus of claim 3 further comprising a spring means which urges said shaft into said housing.

7. The apparatus of claim 1 wherein said upper means for releasable attachment of the shaft to a workstring comprises a grapple neck.

8. The apparatus of claim 2 wherein said upper means for releasable attachment of the shaft to a workstring comprises a grapple neck.

9. The apparatus of claim 3 wherein said upper means for releasable attachment of the shaft to a workstring comprises a grapple neck.

10. The apparatus of claim 1 wherein the lower means for attachment of said housing to a MWD tool comprises a metallic plate having a pattern of holes for bolting said plate to a MWD tool.

11. The apparatus of claim 2 wherein the lower means for attachment of said housing to a MWD tool comprises a metallic plate having a pattern of holes for bolting said plate to a MWD tool.

12. The apparatus of claim 3 wherein the lower means for attachment of said housing to a MWD tool comprises a metallic plate having a pattern of holes for bolting said plate to a MWD tool.

13. The apparatus of claim 1 wherein the lower means for attachment of said housing to a MWD tool comprises a male threaded pin.

14. The apparatus of claim 2 wherein the lower means for attachment of said housing to a MWD tool comprises a male threaded pin.

15. The apparatus of claim 3 wherein the lower means for attachment of said housing to a MWD tool comprises a male threaded pin.

16. The apparatus of claim 1 wherein the lower means for attachment of said housing to a MWD tool comprises a female threaded box.

17. The apparatus of claim 2 wherein the lower means for attachment of said housing to a MWD tool comprises a female threaded box.

18. The apparatus of claim 3 wherein the lower means for attachment of said housing to a MWD tool comprises a female threaded box.

19. A self-adjusting centralizer for use in combination with a MWD tool, comprising:

a) first and second elongate members slidably interconnected longitudinally;

b) a plurality of fingers pivotally attached to the external of the first elongate member;

c) a tapering nose, disposed in the direction of the fingers, attached to the second member; and d) means for attaching one of said elongate members to a workstring and the other of said elongate members to a MWD tool.

* * * * *